US005536998A

United States Patent [19]

Sica

[11] Patent Number: 5,536,998

[45] Date of Patent: Jul. 16, 1996

[54] FLUORESCENT LAMP WITH A PROTECTIVE ASSEMBLY

[75] Inventor: Michael F. Sica, Greenwich, Conn.

[73] Assignee: Royal Lite Manufacturing and Supply Corp., Belleville, N.J.

[21] Appl. No.: 345,843

[22] Filed: Nov. 28, 1994

[51] Int. Cl.[6] ..... H01J 61/30; H01J 61/34

[52] U.S. Cl. ..... 313/489; 313/493; 313/634; 313/25; 362/223; 362/260; 362/377

[58] Field of Search ..... 313/489, 493, 313/634, 25, 258, 486, 17, 20, 110, 112; 220/2.1 R; 362/376, 378, 377, 217, 260, 223

[56] References Cited

U.S. PATENT DOCUMENTS

| | | | |
|---|---|---|---|
| 2,135,696 | 11/1938 | Baumhauer et al. . | |
| 2,363,109 | 11/1944 | Keiffer . | |
| 2,581,959 | 1/1952 | Koehler . | |
| 3,358,167 | 12/1967 | Shanks . | |
| 3,453,470 | 7/1969 | Hammer . | |
| 3,602,759 | 8/1971 | Evans . | |
| 3,720,826 | 3/1973 | Gilmore et al. . | |
| 3,808,495 | 4/1974 | Win | 313/258 |
| 4,048,537 | 9/1977 | Blaisdell et al. . | |
| 4,916,352 | 4/1990 | Haim et al. . | |
| 4,924,368 | 5/1990 | Northrop et al. . | |
| 5,173,637 | 12/1992 | Sica . | |

OTHER PUBLICATIONS

"Standard Specification for Flexible Cellular Materials–Sponge or Expended Rubber", ASTM Designation: D1056–91, Mar. 1992.

*Primary Examiner*—Nimeshkumar D. Patel

*Attorney, Agent, or Firm*—Brumbaugh, Graves, Donohue & Raymond

[57] ABSTRACT

A protective assembly for a standard fluorescent lamp includes a protective tube that is preformed from a semi-rigid, non-frangible polymeric transparent or translucent material that is stabilized against ultraviolet radiation and is received over the glass tube with its inner surface substantially uniformly spaced apart from the outer surface of the glass tube to form an air space for insulation of the lamp. The desired uniform spacing between the lamp tube and the protective tube is established by a spacer ring located adjacent each end of the glass tube and adhesively bonded to the glass tube. Each spacer ring is formed of band of a semi-rigid polymeric foam strip material that is resistant to heat and ultraviolet radiation. The foam spacer ring forms a snug fit with an inner surface of the protective tube but allows the protective tube to be slid lengthwise onto the lamp. The protective tube is securely joined to the lamp by a shrink-fitted collar at each end of the lamp that overlaps and is adhesively joined to the protective tube and the lamp terminal cap.

8 Claims, 1 Drawing Sheet

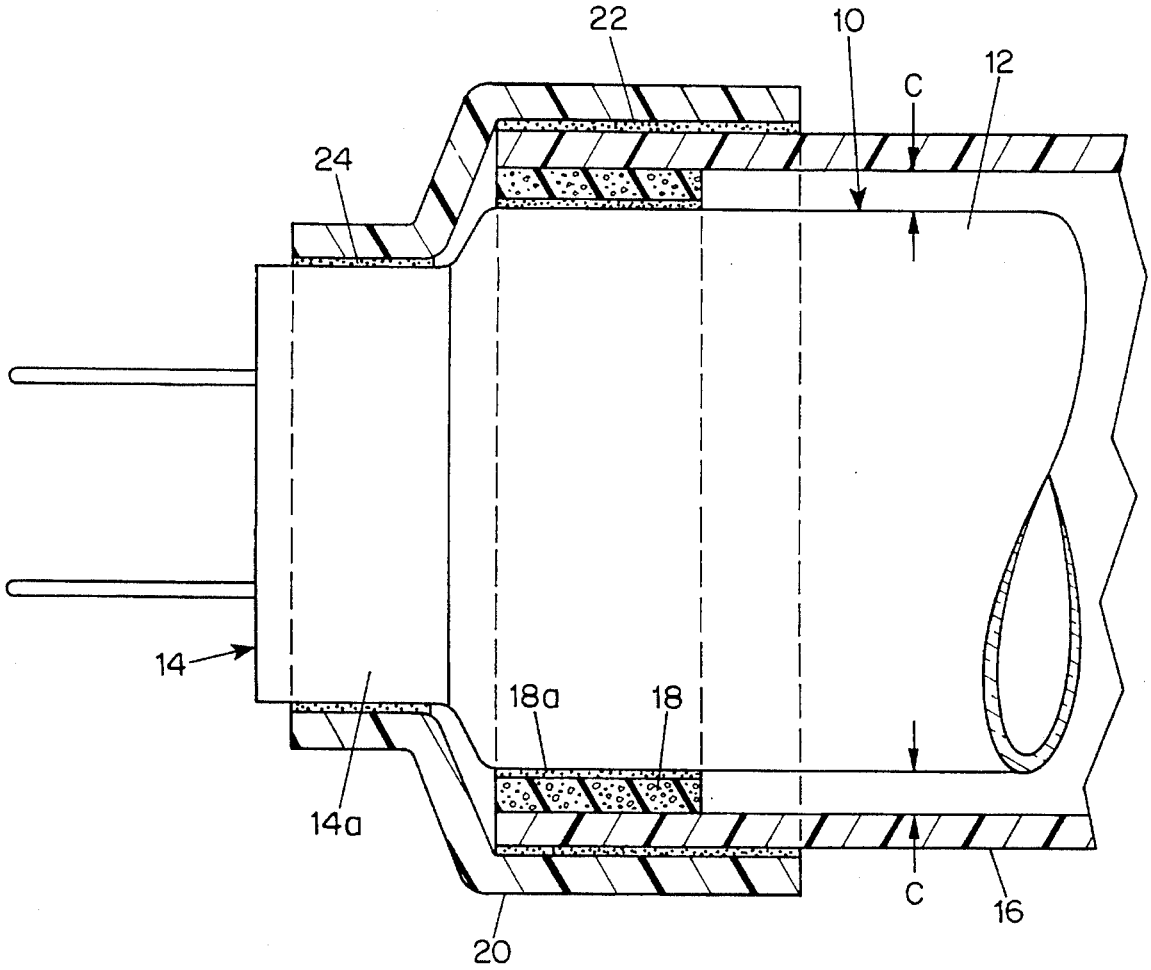
22
10
12
C
24
14
18a
18
14a
C
16
20

FLUORESCENT LAMP WITH A PROTECTIVE ASSEMBLY

BACKGROUND OF THE INVENTION

When fluorescent lamps break, fragments of the glass tube, mercury, and powders from the phosphor coating inside the lamp are scattered about. In places where food is processed or stored, and particularly in lighted display cabinets in supermarkets where stocking clerks and customers handle food in proximity to the cabinet lamps, it is at least highly desirable, and is often required by government regulations, that the cabinet lamps be protected in a way that minimizes the possibility of the lamps being broken and if they do break the possibility of glass fragments, mercury, and phosphor powders escaping and contaminating the food. Fluorescent lamps with a protective assembly are known and widely used for this purpose. Examples of such lamps are those described and shown in U.S. Pat. Nos. 4,048,537 (Blaisdell et al., 1977), 4,924,368 (Northrup et al., 1990), and 5,173,637 (Sica, 1992). The Sica patent is owned by the assignee of the present invention.

Store display cabinets for frozen foods present, in addition to the need for minimizing the possibilities of lamp breakage and escape of glass and powders, a requirement for maintaining the optimum light output of the lamp in the low temperature environment; fluorescent lamps designed to operate at ambient room temperature—about 77° F.—provide much less light output at low ambient temperatures than they provide at room temperature. There have, accordingly, been numerous proposals for adapting fluorescent lamps for low-temperature operation, such as those disclosed in the following U.S. Pat. Nos. 2,135,696 (Baumhauser et al., 1938); 2,363,109 (Keiffer, 1944); 2,581,959 (Koehler, 1952); 3,358,167 (Shanks, 1967); 3,453,470 (Hammer, 1969); 3,602,759 (Evans, 1971); 3,720,826 (Gilmore et al., 1973); and 4,916,352 (Haim et al., 1990).

In most instances, the prior art protective assemblies for fluorescent lamps include special molded end fittings that fit onto the terminal caps of the lamp and hold a protective sleeve in place on the lamp. In some cases, the end fittings are intentionally designed so that they can be removed from the lamp, thus allowing the protective assembly to be reused as lamps burn out and are replaced. Removable protective assemblies do not fully ensure that glass fragments and phosphor powders are retained in case the lamp breaks. Also, protective assemblies that are removable permit smoke and fumes that may be present to be drawn in by a convective flow. The contaminants, such as oil, inducted into the space between the lamp and the protective tube produce unsightly deposits and clouding of the tube. Regardless of whether the end fittings are permanently attached to the lamp or are removable, they are relatively expensive and usually have to be designed for a specific lamp style to ensure a proper fit.

The lamp of the Sica patent provides excellent protection against breakage of the lamp, and if the lamp should break, the protective assembly provides an enclosure that is secure against scattering of glass fragments and phosphor powders. In that regard, a protective tube over the lamp tube is securely joined to the terminal caps of the lamp by collars that both mechanically engage and are adhesively secured to the protective tube and the terminal caps. The Sica lamp is inexpensive to produce, inasmuch as it uses simple tubular elements and commercially available adhesives.

SUMMARY OF THE INVENTION

One object of the present invention is to provide a fluorescent lamp having very effective protection against scattering of glass fragments from the tube and powders from the coating in the event that the lamp breaks. A further object is to provide such protection in a way that does not reduce the light output during the useful life of the lamp due to discoloration or clouding of the protective element. Still another object is to provide a "safety" fluorescent lamp that is easy and inexpensive to produce. Yet another object is to provide a safety fluorescent lamp that may use a standard "room temperature" lamp—designed for about 70° F. ambient temperature—that operates at low ambient temperatures with substantially the same light output as the unprotected lamp operating at normal ambient temperatures. In particular, the protected lamp of the present invention operates efficiently at ambient temperatures as low as −30° F.

The foregoing and other objects are attained, according to the present invention, by a protective assembly for a standard fluorescent lamp of the type having an elongated glass tube and a metal terminal cap at each end of the glass tube, each cap having a flange portion adjacent the glass tube. The assembly includes a protective tube that is preformed from a semi-rigid non-frangible polymeric transparent or translucent material that is stabilized against ultraviolet radiation and is received over the glass tube with its inner surface substantially uniformly spaced apart from the outer surface of the glass tube to form an air space for insulation of the lamp. The protective tube is substantially coextensive with the full diameter portion of the glass tube lengthwise of the lamp. The desired uniform spacing between the lamp tube and the protective tube is established by a spacer ring located adjacent each end of the glass tube and adhesively bonded to the glass tube. Each spacer ring is formed of a semi-rigid polymeric foam strip material that is resistant to heat and ultraviolet radiation and is a band of substantially uniform rectangular cross-section having a thickness such that an outer surface of the ring forms a sliding fit with an inner surface of the protective tube so that the protective tube can be slid lengthwise onto the lamp. The protective tube is securely joined to the lamp by a collar at each end of the lamp. Each collar has a first portion received over an end portion of the protective tube and a second portion received over the flange portion of the cap, is preformed of a heat-shrinkable polymeric material and is heat-shrunk into sealed relation with the protective tube and the cap flange portion. A first adhesive layer is interposed between each collar and the protective tube, and a second adhesive layer is interposed between each collar and the cap flange portion.

The air gap between the lamp tube and the protective tube provides an insulating layer for restricting heat transfer from the lamp to the ambient air outside the protective cover and for circulation of air for convective distribution of heat along the length of the lamp. The protective tube absorbs impacts and minimizes the possibility of the lamp being broken. Should the lamp break, the shrink fit collars, which are joined to the flanges of the lamp terminal caps and the protective tube by an adhesive as well as by mechanically engaging the flanges and the protective tube, maintain the integrity of an enclosure, which is composed of the protective tube, the collars, and the terminal caps, for containment of lamp fragments and phosphor powders.

The foam tape spacer ring provides several functions. First, it is a spacer for the protective tube from the lamp, in that it establishes the air gap uniformly with respect to the lamp tube at each end. Because the protective tube is substantially rigid, the uniformity of the air gap along the entire length of the lamp is ensured by establishing the gap at each end. Second, the foam spacer rings provide thermal insulation at the ends of the air gap and prevent cold spots from forming where the protective tube ends. Third, the foam spacer rings provide impact-absorbing cushions between the protective tube and the lamp tube, this reducing the possibility of impacts to the tube, especially near the ends, causing the lamp to fracture. The spacer rings are joined to the lamp tube by an adhesive, thus ensuring that they will stay in place, not only when the protective tube is slid over the lamp when the protective assembly is installed on the lamp but throughout the life of the lamp. The fit between the spacer ring and the protective tube is a "snug fit," in order to enhance the insulating function but to avoid stressing the lamp tube and to permit sliding the protective tube over the lamp with the spacer rings already in place. Because the ring is a compressible foam, slight compression is possible without making it difficult to slide the protective tube over the lamp.

In a preferred embodiment, each spacer ring is formed of a silicon foam tape, preferably a silicon foam having a compression deflection of from about 6 to about 14 psi for 25% compression (ASTM D1056), and has a thickness of not less than about 3/32 inch, which is the minimum desired thickness of the air gap between the lamp tube and the protective tube. The edge of each spacer ring nearest to the terminal cap of the lamp is, preferably, substantially flush with an end of the protective tube and is also axially substantially coincident with the end of the full diameter portion of the lamp tube, before it necks down. A suitable width for each spacer ring is about 0.5 inch, which is a convenient width to handle during assembly and provides desirable thermal insulating and mechanical cushioning effects.

For a better understanding of the invention reference may be made to the following description of an exemplary embodiment, taken in conjunction with the accompanying drawing.

DESCRIPTION OF THE DRAWING

The drawing is a partial side cross-sectional view of an embodiment of a protective assembly as installed on a conventional fluorescent lamp.

DESCRIPTION OF THE EMBODIMENT

Reference numeral 10 designates a conventional, commercially available fluorescent lamp of the type having an elongated glass tube 12 that necks down slightly at each end and is closed at each end by a cup-like terminal cap 14 having a peripheral flange portion 14*a*. The lamp bases may be of the conventional bi-pin (as shown), single pin or recessed double contact type. The protective assembly consists of a protective tube 16 preformed from a semi-rigid non-frangible transparent polymeric material that is received over the glass tube with a clearance "C" between the outer surface of the glass tube and the inner surface of the protective tube and extends lengthwise substantially coextensively with the glass tube. The clearance or gap "C" between the lamp tube and the protective tube is established and maintained by a spacer ring 18, there being a spacer ring 18 located adjacent each end of the glass tube. Each spacer ring is adhesively bonded to the glass tube by an adhesive layer 18*a*, is formed of a semi-rigid polymeric foam strip material that is resistant to heat and ultraviolet radiation, and is in the form of a band of substantially uniform rectangular cross-section and having a thickness such that an outer surface of the ring forms a snug fit with an inner surface of the protective tube so that the protective tube can be slid lengthwise onto the lamp. A collar 20 preformed from a heat-shrinkable polymeric material is received in overlapping relation over a portion of the protective sleeve at each end thereof and over the flange portion of the adjacent cap. The collar 20 is heat-shrunk into sealed relation with the protective tube 16 and the cap flange portion 14*a*. A layer 22 of an adhesive is interposed between each collar 20 and the corresponding end of the protective tube 16, and an adhesive layer 24 is interposed between each collar 20 and the corresponding cap flange portion 14*a*. No adhesive is present between the glass tube of the lamp and the collars.

In a specific example of the invention, as applied to a 1.50 in. fluorescent tube, the protective tube 16 is a piece cut to a length such as to extend lengthwise over the full diameter portion of the lamp tube (but not over the necked-down parts at either end) from an extrusion of a polycarbonate resin that is highly stabilized against ultra-violet radiation. A suitable clear polycarbonate resin is available from Miles, Incorporated, as Resin No. 3207-1112M50. The protective tube may be clear or translucent and in either case may be colored. The protective tube has a wall-thickness of 3/32 inch, an inside diameter of 1 13/16 inch, and an outside diameter of 2 inch. Therefore, on the radius, the clearance or gap between the outside of the glass tube and the inside of the protective tube is 3/32 inch. The clearance is desirable in that it provides a thermal insulating barrier of air between the glass tube of the lamp and the protective tube that maintains a desirable temperature differential between the lamp tube and the environment outside the protective tube. The gap also allows for flow of convective air currents for maintaining a desirable heat gradient along the length of the lamp.

The spacer rings 18 are strips of silicone rubber foam of substantially uniform, rectangular cross section, having a width of ½ inch and a thickness of 3/32 inch. The foam has a compression deflection of from about 6 to about 14 psi at 25% compression (ASTM D1056). It has an acrylic adhesive coating applied to one face and a release liner over the adhesive. To form the ring, a piece of the foam tape is precut from a supply roll to the required length to wrap around the lamp tube and form a snug butt joint where the two ends meet. The tape is applied to the lamp so that its edge nearer the lamp terminal cap substantially coincides with the end of the protective tube.

The collars 20 are pieces cut to a length of 1½ inch from a tubing product available commercially from 3M, under the designation "FP301." About ¾ inch of the collar overlaps the protective tube. The adhesive is GE PSA and provides additional mechanical retention over and above that provided by shrinking the collar and also provides a moisture barrier and hermetic seal between the lamp and the protective assembly.

If the protected lamp breaks, the protective assembly retains the caps and prevents the dispersal of glass fragments and phosphor powders. The protective assembly does not appear to reduce the light transmission, because the protective tube is entirely transparent.

I claim:

1. A fluorescent lamp with a protective assembly, the lamp having an elongated glass tube and a metal terminal cap at each end of the glass tube and each cap having a flange portion adjacent the glass tube, comprising a protective tube preformed from a semi-rigid non-frangible polymeric transparent or translucent material that is stabilized against ultraviolet radiation, the protective tube being received over the glass tube and having an inner surface substantially uniformly spaced apart from an outer surface of the glass tube to form an air space for insulation of the lamp and being substantially coextensive with the glass tube lengthwise of the lamp, a spacer ring located adjacent each end of the glass tube and adhesively bonded to the glass tube, each spacer ring being formed of a semi-rigid polymeric foam strip material that is resistant to heat and ultraviolet radiation, each spacer ring being in the form of a band of substantially uniform rectangular cross-section, and each spacer ring having a thickness such that an outer surface of the spacer ring forms a snug fit with an inner surface of the protective tube while permitting the protective tube to be slid lengthwise onto the lamp, a collar at each end of the lamp, each collar having a first portion received over an end portion of the protective tube and a second portion received over the flange portion of the cap, and each collar being preformed of a heat-shrinkable polymeric material and being heat-shrunk into sealed relation with the protective tube and the cap flange portion, a first adhesive layer interposed between each collar and the protective tube, and a second adhesive layer interposed between each collar and the cap flange portion.

2. A fluorescent lamp according to claim 1 wherein each spacer ring is formed of a silicon foam tape.

3. A fluorescent lamp according to claim 1 wherein each spacer ring is formed of a silicon foam tape having a compression deflection of from about 6 to about 14 psi for 25% deflection when tested according to ASTM D1056.

4. A fluorescent lamp according to claim 1 wherein each spacer ring has a thickness of not less than about 3/32 inch.

5. A fluorescent lamp according to claim 4 wherein each end of the protective tube is axially substantially coincident with an end of a full diameter portion of the lamp tube.

6. A fluorescent lamp according to claim 1 wherein each spacer ring has an edge that is substantially flush with an end of the protective tube.

7. A fluorescent lamp according to claim 1 wherein each spacer ring has a width of about 0.5 inch.

8. A fluorescent lamp according to claim 1 wherein each spacer ring is formed of a silicon foam tape having a compression deflection of from about 6 to about 14 psi for 25% deflection when tested according to ASTM D1056 and has a thickness of not less than about 3/32 inch and a length of about 0.5 inch, and has an edge that is substantially flush with an end of the protective tube, and wherein each end of the protective tube is axially substantially coincident with a juncture between the glass tube and the terminal cap.

* * * * *